United States Patent [19]

Spadini

[11] Patent Number: 4,956,827

[45] Date of Patent: Sep. 11, 1990

[54] TIMEPIECE

[76] Inventor: Paolo Spadini, 6, Rue du Gothard, 1225 Chêne-Bourg, Switzerland

[21] Appl. No.: 258,608

[22] Filed: Oct. 17, 1988

[30] Foreign Application Priority Data

Oct. 21, 1987 [CH] Switzerland ..... 4114/87

[51] Int. Cl.[5] ..... G04C 17/00; G04B 1/00

[52] U.S. Cl. ..... 368/69; 368/204; 368/276

[58] Field of Search ..... 368/76, 80, 88, 69–70, 368/185–187, 203, 204, 276, 289, 291, 294, 309, 320, 321

[56] References Cited

U.S. PATENT DOCUMENTS 4,244,044 1/1981 Olsson ..... 368/289
4,492,479 1/1985 Hatsuse et al. ..... 368/109

FOREIGN PATENT DOCUMENTS 0024893 3/1981 European Pat. Off. .
0099308 1/1984 European Pat. Off. .
840223 6/1984 World Int. Prop. O. .

*Primary Examiner*—Vit W. Miska
*Attorney, Agent, or Firm*—Wenderoth, Lind & Ponack

[57] ABSTRACT

In a housing there is accommodated a quartz-controlled watchwork together with a display covered by a viewing or sight window and with at least one contact serving to accomplish control functions. The contact can be actuated by the base or floor of the housing, for instance by an actuator in the form of a pusher which piercingly extends through the housing base or floor. To facilitate actuation of the contact the housing is mounted to be displaceable, against the action of a spring, in a casing or receptacle. By applying a force, such as pressure upon the viewing window the pusher and thus the contact can be actuated.

24 Claims, 2 Drawing Sheets

TIMEPIECE

BACKGROUND OF THE INVENTION

The present invention broadly relates to timepieces and, more specifically, to a new and improved construction of a watch or clock, hereinafter generally simply referred to as a watch.

In its more specific aspects, the invention pertains to a watch containing a quartz-controlled watchwork or mechanism accommodated in a housing. There is also provided in the housing a display or display means covered by a viewing or sight window. Furthermore, the watch comprises at least one contact arranged internally of the housing and serving for accomplishing control functions. This contact can be actuated or activated from the base or floor of the housing.

It is known in this technology to provide quartz-controlled watchworks or movements with at least one contact arranged internally of the watch housing. This contact serves, for instance, to govern functions of the watch and/or to set the exact time at the watch.

In order to actuate such contacts there are usually provided pushers or keys or buttons which can be positively actuated without having to resort to any auxiliary expedients. Such pushers or pusher elements should possess predetermined minimum dimensions. Pushers or keys or buttons which protrude laterally, somewhat in the fashion of a conventional winding crown, from the watch casing or housing, for example at mens wristwatches, do not have any unpleasant or disturbing effect and also can be comparatively easily realized from the technological stand point. On the other hand, laterally protruding keys or buttons or the like not only are aesthetically disturbing or unsightly in the case of small and/or flat watchworks, such as those used for ladies wristwatches, but also because of the small size of the watch casing or housing, on the one hand, and the minimum dimensions of the pusher or pusher element, on the other hand, are difficult to accommodate within the watch and to actuate or operate.

Therefore, there has become know to the art a watchwork, especially although not exclusively, for ladies wristwatches, wherein the pusher, which serves to accomplish a number of functions, piercingly extends through the base or floor of the watch housing or casing. As a result, when the watch is worn the pusher is not visible. With this prior art design certain drawbacks as concerns the aesthetic appearance of the watch and difficulties of a technological nature are eliminated, yet such is only accomplished at the expense of other shortcomings or drawbacks. Thus, for instance, in the case of a wristwatch having a key or pusher at the base or floor of the watch such cannot be readily actuated during the time that the wristwatch is worn by the user. Additionally, the key or button is in continuous contact with the skin of the user and thus prone to soiling or contamination. If the key or pusher is flush with the outer surface of the base or floor of the watch housing or casing, the danger of soiling or contamination is less, yet in order to actuate the pusher there is required a pointed object.

SUMMARY OF THE INVENTION

Therefore, with the foregoing in mind it is a primary object of the present invention to provide a new and improved construction of watch which is not afflicted with the aforementioned drawbacks and limitations of the prior art constructions.

Another and more specific object of the present invention aims at the provision of a new and improved construction of a watch of the previously mentioned type wherein actuation of the contact can be accomplished in an appreciably simpler fashion, especially when dealing with small and flat watches, typically ladies watches.

Now in order to implement these and still further objects of the invention which will become more readily apparent as the description proceeds, the watch of the present development, among other things, is manifested by the features that the housing is displaceable in a casing or receptacle against a spring or resilient action so that by applying force, such as pressure to the housing or to the viewing or sight window thereof the contact can be actuated.

If actuation of the contact is accomplished by the provision of a pusher or pusher element which piercingly extends through the base or floor of the housing, then such pusher or pusher element can be actuated by applying force, typically pressure to the housing, without the pusher normally being visible. The casing or receptacle can be constituted by an additional substantially bowl or cup-shaped part in the manner of an outer housing or casing in that the watch housing or casing is supported upon a pressure or compression spring. This bowl or cup-shaped portion can completely enclose the actual watch housing or casing with the exception of the viewing or sight window.

However, the receptacle or casing can also be constituted by a recessed portion accommodated to the form or shape of the watch housing or casing. This recessed portion is formed in a socket part or component, for instance composed of glass, crystal or artificial or synthetic stone.

Since the watch contains absolutely no laterally protruding parts such type of watch can be considered as a so-to-speak "crownless" watch. This is so because the pusher or pusher element which piercingly extends from the base or floor of the housing or casing of the watch or the flexible membrane which forms the base or floor of the housing or casing of the watch, normally is not visible.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
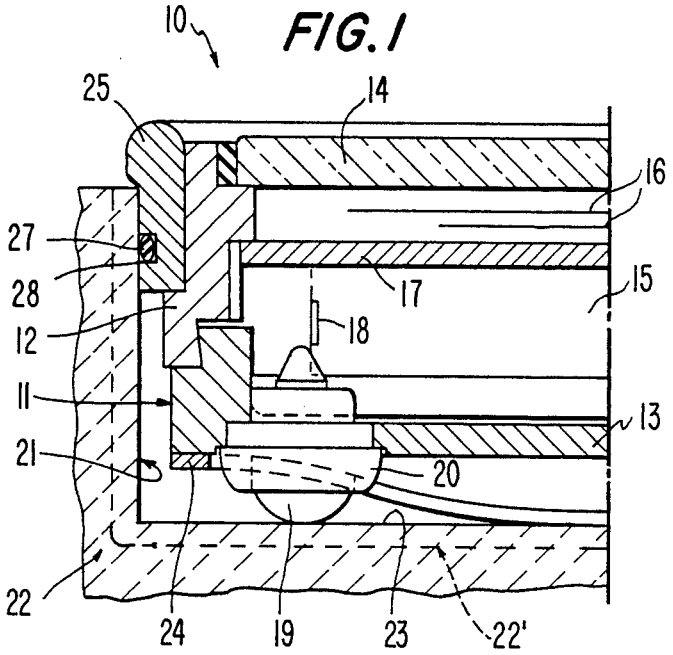
FIG. 1 is a fragmentary schematic sectional view through a first exemplary embodiment of a watch which is installed in a socket portion and with the pusher or pusher element in an unactuated state or condition.

Describing now the drawings it is to be understood that to simplify the illustration thereof only enough of the construction of the timepiece, whether such be a wristwatch or clock, it being recalled such is generically referred to simply herein as a "watch", has been illustrated therein as needed for those skilled in the art to readily understand the underlying teachings and principles of the present invention while simplifying the showing of the drawings. Turning attention now specifically to FIGS. 1 and 2, there will be recognized an exemplary embodiment of watch 10 which is shown to possess a housing or casing 11 provided with an intermediate or central portion 12. A base or bottom 13 is snapped or snap-fitted to the intermediate portion or part 12 at one end thereof and the other end of this intermediate portion or part 12 has inserted therein a watch glass 14 forming a viewing or sight window. Within the housing or casing 11 there is arranged a battery-operated quartz-controlled watchwork or movement 15.

Continuing, the watchwork or movement 15 which is equipped with a not particularly depicted but suitable stepping motor operates or drives the watch hands 16 which coact with a watch dial or face 17 of an analogue display visible through the transparent watch glass 14.

In the battery-operated and quartz-controlled watchwork or movement 15 there is provided a contact or contact spring 18 which can be actuated by an actuator or actuator element, here shown as a pusher or pusher element 19. This pusher or pusher element 19 is displaceably mounted in a fitting 20 which is pressed into the base or floor 13 of the watch housing or casing 11.

The entire watch housing or casing 11 together with the watchwork or movement 15 is displaceably embedded within a receptacle or casing, here in the form of a recess portion or recess 21 provided within a socket part or component 22. This socket part or component 22 can be constructed as the intermediate portion of a decorative wristwatch but also can be constituted by the socket or pedestal of a table or desk clock or watch. As has been shown in phantom lines in FIG. 1 and designated by reference character 22' the receptacle or casing can be, however, also constituted by a bowl or cup-shaped outer housing or casing portion which encloses the watch housing or casing 11 with the exception of the watch glass 14.

The housing 11 is supported at the base or floor 23 of the recess portion or recess 21 by means of a substantially ring-shaped and undulated or bent blade or leaf spring 24 or equivalent structure and which engages at the circumference of the base or floor 13 of the watch housing 11. In order to ensure that the watch housing or casing 11 is retained in the recess portion or recess 21 and its rest position remains defined or fixed, a stop or check ring or ring member 25 or an equivalent retention structure is removably fixedly clamped in the recess portion or recess 21 at the upper edge portion or region thereof. This stop or check ring 25 cooperates with a shoulder or stepped portion 26 which is formed at the intermediate portion 12 of the watch housing or casing 11, as best seen by referring to FIG. 2. This stop or check ring 25 is also provided with an outwardly open circumferential or outer groove 27 in which there is arranged an O-ring or ring member 28 which bears against the inner wall of the receptacle here constituted by the recess portion 21. This O-ring 28 furnishes the clamping force required for the fixed clamping of the stop or check ring 25.

Figure 2:
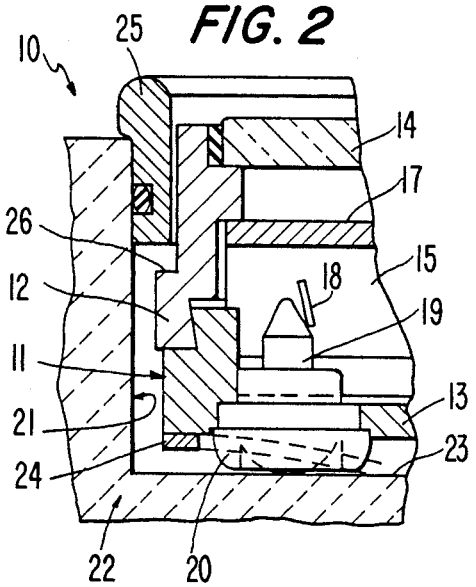
FIG. 2 is a fragmentary sectional view of the watch depicted in FIG. 1 wherein the pusher or pusher element is however actuated.

In order to actuate the pusher or pusher element 19, for instance for setting the time of day at the watch, it is only necessary to apply a force, such as pressure or a compressive action upon the watch glass 14 which, in turn, displaces the housing 11 into the position depicted in FIG. 2. In the event that the battery compartment (not shown) of the watchwork or mechanism 15, and which battery compartment is usually accessible from the watch base or floor 13, should be provided with a new battery, then it is only necessary to remove the stop or check ring 25 and the housing or casing 11 of the watch 10 can be easily removed out of the recess portion or recess 21. The renewed insertion of the stop or check ring 25 is not associated with any difficulties, even if there are not resorted to the use of any special auxiliary tools.

In the event that the watchwork or movement 15 is of the type equipped with an alarm device, which likewise can be turned on and turned of by means of a pusher or pusher element arranged at the base or floor side of the housing or casing 11, also this pusher or pusher element can be piercingly arranged for instance at the side of the watch base or floor 13 which is situated diametrically opposite the previously discussed pusher or pusher element 19. In such case, in order to actuate the one or the other pusher or pusher element it is only necessary to apply pressure to the watch glass 14 at the location corresponding to the pusher or pusher element which is intended to be actuated or operated.

A further advantage of the described watch in relation to watches having laterally protruding pushers or the like resides in the fact that the pusher or pusher element 19 so-to-speak is not visible and notwithstanding its comparatively small dimensions can be still readily actuated. If the socket part or component 22 is made of a decorative, transparent or translucent, yet very brittle material, for example, of glass, crystal or of a semi-precious or artificial stone, in which a recess such as the recess portion or cavity 21 can be indeed worked without any great difficulties, then the drilling or machining of a hole or the like leading into the recess portion or cavity 21 for the passing through of the pusher or pusher element can be dispensed with in the watch 10 constructed according to the invention.

Safeguarding of the undulated or bent blade or leaf spring 24 against loss can be accomplished by affixing such to a point or location of the watch base or floor 23 of the recess portion or to the base or floor 13 of the housing 11, the fixing or anchoring operation being accomplished, for instance, by providing an adhesive bond or other suitable attachment connection.

At this point there will be considered a modified construction of watch 10 which has been depicted in FIG. 3, it being noted that there have been generally used the same reference characters to denote the same or analogous components as for the embodiment of watch heretofore described with reference to FIGS. 1 and 2.

Figure 3:
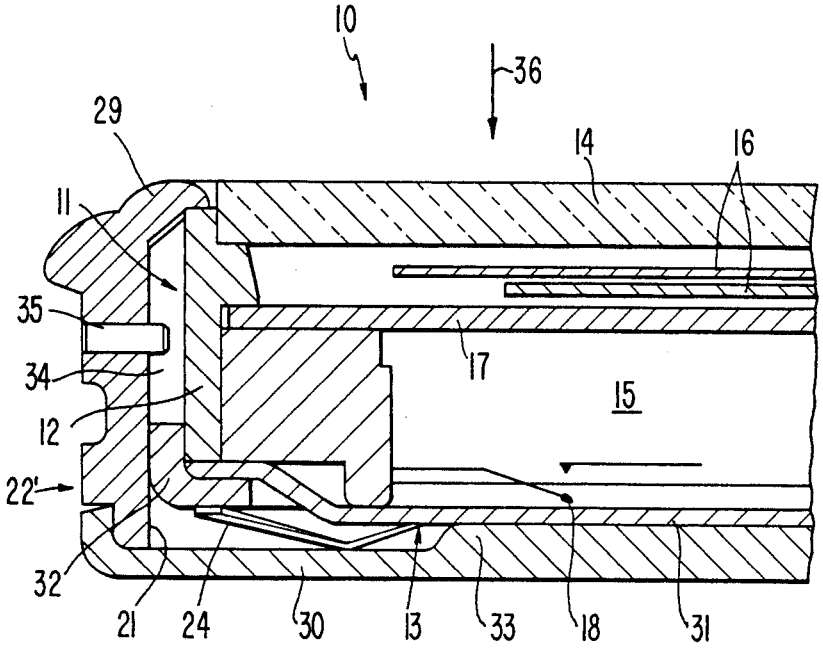
FIG. 3 is a fragmentary schematic sectional view of a second exemplary embodiment of watch constructed according to the invention.

One difference between the embodiment of watch of FIG. 3 and that depicted in FIGS. 1 and 2 resides in the fact that the housing or casing 11 is arranged in a two-part or two-component outer housing or casing 22'. This outer housing or casing 22' comprises a ring portion or part 29 which engages over the intermediate part or portion 12 of the housing or casing 11 and a base portion or part 30 which is snapped on to the ring portion or part 29. Furthermore, the base or floor 13 of the housing 11 for the most part is formed by an elastically bendable or deformable membrane or diaphragm 31 or equivalent structure which is fixedly sealingly clamped by means of a snap or retainer ring 32 or equivalent structure at the lower end face or side of the intermediate portion or part 12. The outer diameter of the snap or retainer ring or ring member 32 essentially corresponds to the outer diameter of the intermediate portion or part 12 and in any event is selected such that the housing or casing 11 is mounted in a sliding fit in the recess portion or recess 21 which is formed by the outer housing or casing 22'.

The elastically deformable or bendable membrane 31 bears at its intermediate or central region upon a raised portion or protuberance 33 which extends from the base portion 30 into the interior of the recess portion or recess 21. Finally, there is formed at the circumference of the intermediate portion 12 a lengthwise or longitudinally extending groove or slot 34 into which engages a securing member, here in the form of a pin or stem 35 which is pressed into the circumferential wall of the ring portion 29. In this way the housing or casing 11 is secured against rotation or turning in relation to the outer housing or casing 22' and there can be effectively precluded so-called "wiping movements" of the elastically bendable or deformable membrane 31 upon the raised portion or protuberance 33. In the event that the contact or contact spring 18, here only schematically depicted, should be actuated, then it is sufficient to apply a force, here pressure or a compressive action in the direction of the arrow 36 of FIG. 3 which is adequate in order to overcome the action of the resilient or spring member 24. The elastically bendable or deformable membrane 31 is bent-through and actuates by means of the side or face thereof which confronts the watchwork or movement 15 the schematically depicted contact or contact spring 18.

Apart from the advantages which have already been enumerated previously in conjunction with the embodiment of watch depicted and described with reference to FIGS. 1 and 2, the modified embodiment of watch depicted in FIG. 3 has the advantage that it affords a flatter construction of the watch, particularly if it is intended to be used, for instance, for a wristwatch.

However, it should be understood that the housing or casing 11 of the embodiment of watch depicted in FIG. 3 also can be installed in a recess or recess portion within a socket part or component provided that the base or floor of this recess or recess portion is provided with a raised portion or protuberance which is capable of bending-through the elastically bendable or deformable membrane or diaphragm 31, upon application of pressure to the watch housing or casing 11, to such an extent that the contact 18 or the like can be reliably actuated.

While there are shown and described present preferred embodiments of the invention, it is to be distinctly understood that the invention is not limited thereto, but may be otherwise variously embodied and practiced within the scope of the following claims. ACCORDINGLY,

WHAT I CLAIM IS:

1. A watch comprising:

a housing;

a quartz-controlled watchwork arranged in said housing;

display means arranged in said housing;

a viewing window provided for said housing and covering said display means;

said housing having a base;

at least one contact arranged internally of said housing and serving for accomplishing control functions of the watch;

said contact being actuatable from the base of the housing;

resilient means acting upon said housing;

receptable means; and said housing being displaceably mounted against the action of said resilient means in said receptacle means so that upon application of pressure to at least one of the housing or the viewing window said contact is actuated.

2. The watch as defined in claim 1, wherein:

said receptacle means comprises a substantially bowl-shaped receptacle; and said substantially bowl-shaped receptacle enclosing said housing with the exception of said viewing window.

3. The watch as defined in claim 1, wherein:

said receptacle means comprises a socket portion having a recess within which there is embedded said housing.

4. The watch as defined in claim 1, wherein:

said resilient means comprises a pressure spring;

said receptacle means comprising a base; and said base of said housing being supported by said pressure spring at the base of said receptacle means.

5. The watch as defined in claim 1, further including:

stop means provided for said receptacle means for fixing a rest position of said housing within said receptacle means.

6. The watch as defined in claim 4, wherein:

said pressure spring comprises an undulated blade spring.

7. The watch as defined in claim 5, wherein:

said stop means defines a substantially ring-shaped stop;

said receptacle means has an upper edge portion; and said substantially ring-shaped stop being fixedly but removably clamped at the upper edge portion of said receptacle means.

8. The watch as defined in claim 7, wherein:

said receptacle means has an inner wall;

said substantially ring-shaped stop comprises an outwardly open ring-shaped groove; and said stop means further comprises a sealing element arranged in said outwardly open ring-shaped groove and pressing against said inner wall of said receptacle means.

9. The watch as defined in claim 3, wherein:

said socket portion is formed of a transparent material.

10. The watch as defined in claim 9, wherein:

said transparent material comprises glass.

11. The watch as defined in claim 9, wherein:

said transparent material comprises crystal.

12. The watch as defined in claim 9, wherein:

said transparent material comprises an artificial stone.

13. The watch as defined in claim 9, wherein:

said transparent material comprises a semi-precious stone.

14. The watch as defined in claim 3, wherein:

said socket portion is formed of a translucent material.

15. The watch as defined in claim 14, wherein:
said translucent material is formed of glass.
16. The watch as defined in claim 14, wherein:
said translucent material is formed of crystal.
17. The watch as defined in claim 14, wherein:
said translucent material is formed of artificial stone.
18. The watch as defined in claim 14, wherein:
said translucent material is formed of a semi-precious stone.
19. The watch as defined in claim 4, wherein:
said pressure spring is anchored at a predetermined location at the base of the housing.
20. The watch as defined in claim 4, wherein:
said pressure spring is anchored at a predetermined location at the base of the receptacle means.
21. The watch as defined in claim 1, wherein:
said base of said housing is constituted by a flexible membrane;
said receptacle means comprises an external housing having a removable base;
said removable base having a side confronting said flexible membrane;
said side of said removable base confronting said flexible membrane being provided with a raised portion so that pressure exerted to at least one of the housing or the viewing window causes the flexible membrane to bend-through and to thus actuate the contact.
22. The watch as defined in claim 1, further including:
means for securing the housing within said receptacle means against rotation.
23. The watch as defined in claim 1, further including:
pusher means displaceably extending through said base of said housing; and
said pusher means actuating said contact.
24. A watch comprising:
a housing;
a quartz-controlled watchwork arranged in said housing;
display means arranged in said housing;
a viewing window provided for said housing and covering said display means;
said housing having a base;
at least one contact means arranged internally of said housing and serving for accomplishing at least one predetermined control function of the watch;
said contact means being actuatable from the base of the housing;
resilient means acting upon said housing; receptacle means; and
said housing being displaceably mounted against the action of said resilient means in said receptacle means so that upon application of a force selectively to at least one of the housing or the viewing window said contact means is operated.

* * * * *